US005217265A

United States Patent [19]

Lerner et al.

[11] Patent Number: 5,217,265

[45] Date of Patent: Jun. 8, 1993

[54] CHILD-RESISTANT LATCH RELEASE MECHANISM

[75] Inventors: Neil D. Lerner, Gaithersburg; Richard W. Huey, Jr., Bel Air, both of Md.

[73] Assignee: Comsis Corporation, Silver Spring, Md.

[21] Appl. No.: 880,004

[22] Filed: May 8, 1992

[51] Int. Cl.[5] ..... E05C 3/10

[52] U.S. Cl. ..... 292/200; 292/196; 292/DIG. 15

[58] Field of Search ..... 292/200, 108, 210, 153, 292/255, 188, 233, 94, DIG. 65, DIG. 36, DIG. 15

[56] References Cited

U.S. PATENT DOCUMENTS

| | | | |
|---|---|---|---|
| 276,626 | 5/1883 | Powell | 292/255 |
| 533,571 | 2/1895 | Tower | 49/277 |
| 663,791 | 12/1890 | Simmons | 292/233 |
| 866,766 | 9/1907 | Austad | 292/233 |
| 911,175 | 2/1909 | Stevenson et al. | 292/94 |
| 1,071,058 | 8/1913 | Kirkpatrick | 292/233 |
| 1,117,877 | 11/1914 | McAllister | 292/255 |
| 1,183,090 | 5/1916 | Louden | 292/210 X |
| 1,204,072 | 11/1916 | Royack | 292/94 |
| 1,210,826 | 1/1917 | Minor | 297/210 X |
| 1,245,057 | 10/1917 | Stillings et al. | 292/255 |
| 1,253,545 | 1/1918 | Tompkins et al. | 292/216 |
| 2,397,926 | 4/1946 | Creech | 292/255 |
| 2,528,954 | 11/1950 | Harbert | 292/210 |
| 2,759,782 | 2/1953 | Goodwin, Jr. | 292/227 |
| 2,777,315 | 1/1957 | Burke | 292/DIG. 71 X |
| 4,025,095 | 5/1977 | Hausladen | 292/210 |

*Primary Examiner*—Richard E. Moore

*Attorney, Agent, or Firm*—Roylance, Abrams, Berdo & Goodman

[57] ABSTRACT

A child-resistant latch release mechanism which requires operation of two control members which are separated by a distance greater than that which can be effectively spanned by a preschool child. The two control members must be operated first in a certain sequence and then simultaneously in order to permit operation of the latch release mechanism. Conventional self-latching upon closure is retained by the invention latch release mechanism.

17 Claims, 4 Drawing Sheets

CHILD-RESISTANT LATCH RELEASE MECHANISM

FIELD OF THE INVENTION

This invention relates to latch release mechanisms for fence gates, conventional doors and the like. More in particular, it relates to such latch release mechanisms which are resistant to operation by preschool children.

DISCUSSION OF THE PRIOR ART

The present invention pertains to latches for us with doors, fences and other enclosures. It is particularly adapted to making the door, fence or the like resistent to operation by children, i.e., to keep children out of prohibited areas.

Many small children drown in home swimming pools each year. The prior art has many sorts of alarms and the like to alert the parents if the child gets into the water. However, this is often too late, that is, the child is already subjected to danger, and the parent may not be able to get to the child fast enough to save him or her from injury or death.

Fences are regularly provided around home swimming pools, and fences are also used to enclose other dangerous areas from which it is desired to exclude small children. Likewise, doors close off many areas where it is undesirable for small children to enter. In all of these cases, that is, fences around home swimming pools, fences around other dangerous areas such as electrical equipment and the like, many sorts of doors, and in other areas of use that may arise and that will present themselves to those skilled in various arts in which the invention can be used, the gate or door is the weak point. The most desirable result is to keep the child from going through the door or gate and into the prohibited or enclosed area entirely.

The prior art includes latches which are located relatively high on the door or gate. These have proven to be ineffective because the child can usually find a chair or other device upon which to climb to operate the latch.

The prior art also uses various lock and key arrangements to prevent child access. All such mechanisms, however, require a key for any person to use it. If the key is accessible, the prohibited area is as well, regardless of the user's age, children included. Likewise, if the key is not available, in an emergency situation for example, the area will be inaccessible to all persons not possessing the key. Thus, the invention has advantages over and is to be distinguished from all such prior art devices which use keys.

Another prior solution to the problem is to provide some kind of latch mechanism that requires substantial strength to operate. The problem with this solution is that elderly or handicapped or other adult persons may not be strong enough to operate such a latch.

A main object of the present invention is to provide an improved door or fence gate latch release mechanism which prevents its use by preschool children and which solves all of these problems in the prior art.

The invention can also be applied to conventional doors to keep children out of selected rooms or spaces, i.e., a work shop, study, bedroom, or the like. There are many such prohibited areas and many reasons to exclude children from them, and the present invention latch release mechanism can be used to advantage in all such environments.

SUMMARY OF THE FEATURES AND ADVANTAGES OF THE INVENTION

The present invention teaches a latch release mechanism which includes two interlocking latch actuation controls. The two controls are separated by a substantial distance or span which prevents a preschool child from operating both controls simultaneously. The two controls are interlocked in such a way that first one must be operated and held in the operated position, and then the second one operated, i.e., a sequential and then simultaneous operation.

More in detail, the present invention, in its preferred embodiments, teaches a control member which must be lifted vertically and held in the lifted position. The lifting of this control member enables a foot pedal to be used to operate the latch. This sequential and then simultaneous operation of the two controls must be accomplished in that order in order for the gate or door to be unlatched. If the upper or lower control is worked independently, or if an attempt is made to work the lower control first, the latch will not open or release.

The present invention also teaches an arrangement of a special knob on the upper control member and a protective sheath or cup around this knob which prevents this knob and the upper control member from being propped up with a rod or a stick or other tool by a clever child, which might otherwise enable the child to then operate the lower control and open the gate or door.

Studies performed during the development of the invention and anthropometric data obtained from the U.S. government show that a distance of at least 48 inches between the upper and lower controls will prevent their simultaneous operation by preschool children.

The invention also allows conventional self-latching of the latch with the keeper when closing the gate or door.

The above and other features and advantages of the invention will become evident to those skilled in these arts from a reading of this entire specification including the attached drawings which form a part thereof.

DETAILED DESCRIPTION OF THE PREFERRED EMBODIMENTS

Figure 1:
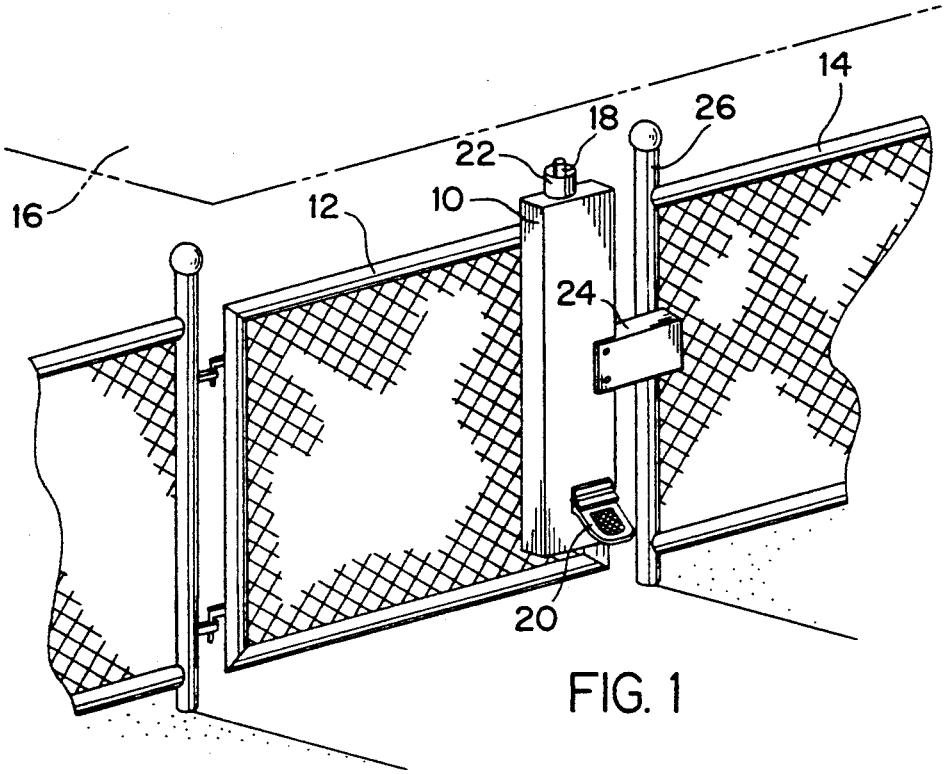
FIG. 1 is a perspective view showing a fence surrounding a home swimming pool with a first embodiment of the invention latch release mechanism in place.

Referring now to FIG. 1, the first embodiment of the invention latch release mechanism 10 is shown attached to a gate 12 forming part of a fence 14. The fence 14 encloses a home swimming pool 16. While this environment of keeping preschool children away from home swimming pools is thought to be a major area of application of the invention, the invention can also be applied to other environments, such as keeping small children away from dangerous equipment and the like, as well as out of prohibited spaces in general, such as rooms or other spaces closed or controlled by conventional doors, as is described below in regard to the second embodiment of the invention.

Latch 10 includes an upper control knob 18 which is housed in a cup 22. The mechanism also includes a pair of foot operated pedals 20 (see FIG. 6) at the lower end of latch 10. Only one pedal 20 is used in the second embodiment of FIGS. 7-9.

The distance between knob 18 and pedal 20 is at least 48 inches. Government studies show that preschool children cannot effectively span such a distance to operate the latch release mechanism of the invention. More specifically, during development of the invention, reference was had to:

Snyder, R., Schneider, L., Owings, C., Reynolds, H., Golomb, D., and Schork, M. (1977). *Anthropometry of infants, children and youths to age* 18 *for product safety design.* Washington, D.C.: U.S. Consumer Product Safety Commission.

Figure 5:
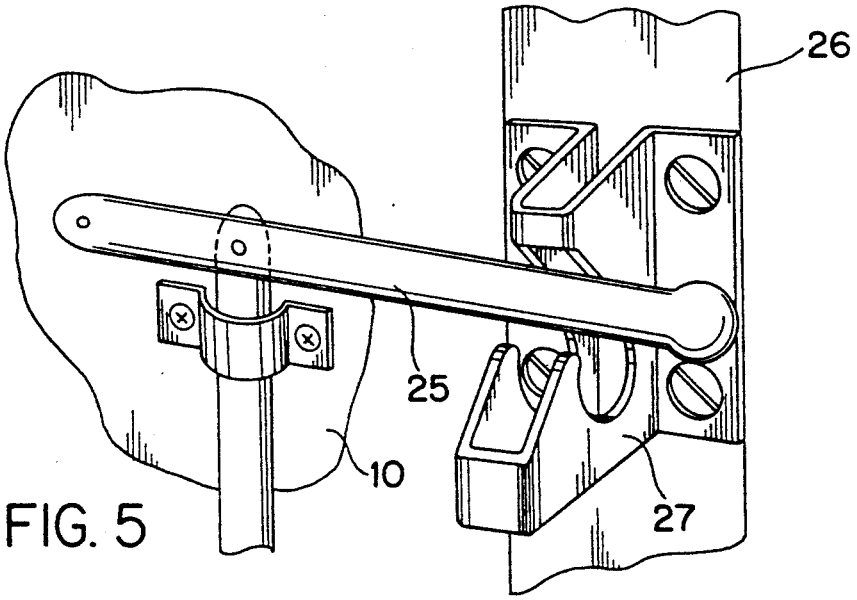
FIG. 5 shows the latch and the keeper in perspective, with the protective shield removed according to the first embodiment of the invention.

The invention latch release mechanism 10 includes a housing 24 which encloses a conventional latch 25 which cooperates with a conventional keeper 27 on the cooperating post 26 of fence 14 (see FIG. 5). The housing 24 substantially entirely encloses and prevents hand operation of latch 25.

Figure 2:
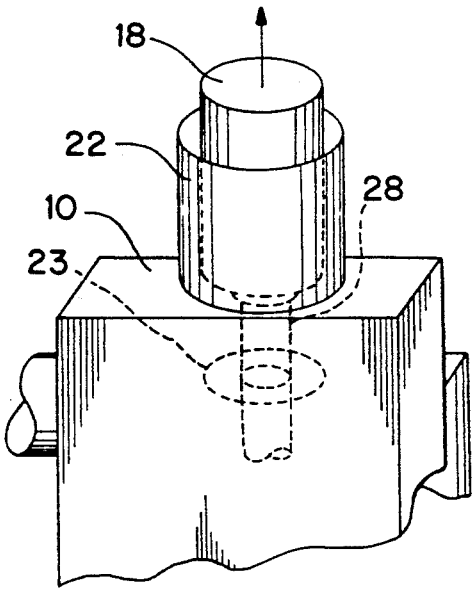
FIG. 2 is an enlarged showing of the upper control knob.
Figure 3:
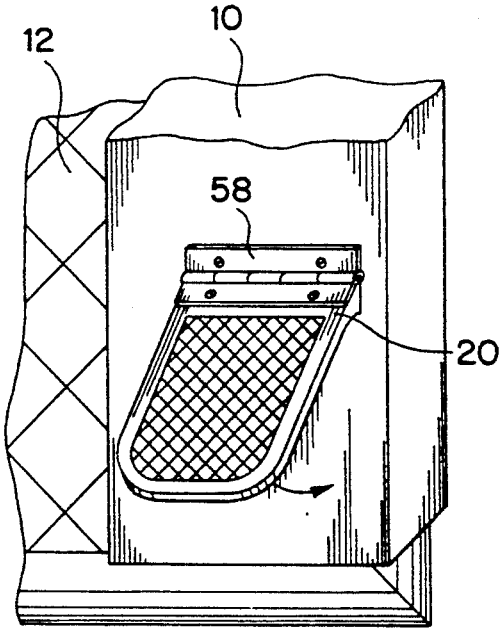
FIG. 3 is an enlarged showing of the foot pedal at the lower end of the invention latch release mechanism.

Referring now to FIG. 2, there is shown the upper end of the invention latch release mechanism 10 including the control knob 18 and its protective cup 22. Within the housing 10, the control knob 18 is fixed to an upper control member 28. A stop washer or the like 23 fixed to member 28 defines the maximum height to which knob 18 can be raised within cup 22.

The vertical heights of the knob 18 and the cup 22 are such that in the inactive position part of the knob 18 will protrude out above the cup 22 to allow a user to grasp the knob 18. Further, the parts are so configured that when the knob is raised to its full height defined by stop 23, still at that time, part of the length of the knob 18 at its lower end will be housed within the cup 22. In experimental work done in developing the invention, this part at the lower end has been made to be about one-quarter of the length of the knob. This arrangement of the parts will thwart any effort by a small child to prop the knob 18 in the up position so that he could operate a foot pedal 20 and thus avoid the operation method required by the invention. The configurations of the parts are further made such that the part of the length of the knob 18 which protrudes out above the cup allows any user to grasp the knob 18 and operate the attached control member 28. The knob 18 is relatively close fitting within the cup 22 for the purpose of preventing it from being propped into the up position. And, again, for these same purposes, the control knob 18 is smooth on its external surface. Any shape could be used for the mating cup 22 and knob 18; a simple cylinder shape is preferred.

The control knob, the cup, and other parts of the invention latch release mechanism may be made of metal, plastics, other materials, and combinations thereof; the particular materials used are not deemed to be elements of the invention itself.

Figure 4:
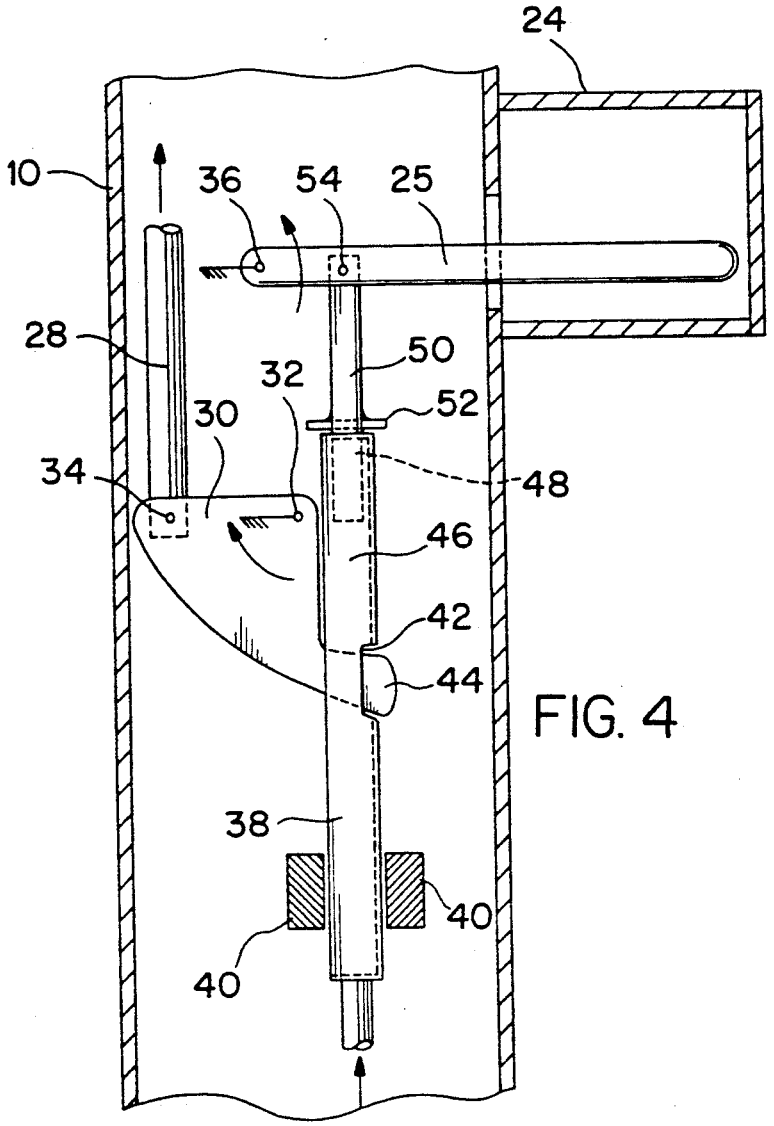
FIG. 4 is a somewhat schematic vertical elevational view of the latch release mechanism according to the first embodiment of the invention, with some parts broken away and in cross-section.

Referring now to FIG. 4, the first embodiment of the latch release mechanism of the invention is shown in a somewhat schematic vertical elevational view with some parts broken away and in cross-section.

The lower end of the upper control member 28 is pivotally connected to a lock member 30 at a pivot point 34. The lock member 30 is fixedly and pivotally connected to the housing 10 at pivot 32 as indicated by the flag device on FIG. 4. A similar flag device indicates fixed pivot 36 provided for the latch 25 where it is fixedly and pivotally connected to the housing 10. A lower control member 38 is arranged within housing 10 for vertical motion therein by way of fixed guide members 40. Member 38 may be made of angle iron, pipe, or the like appropriately shaped material to act as a guide. It is formed with an opening 42 through which a finger portion 44 of the lock member 30 protrudes in the secured position of the parts which is shown in FIG. 4. That is, FIG. 4 shows the safety, closed, or interlocked position of the parts of the invention latch release mechanism.

The upper end of the lower control member 38 is formed with a hollow space 46. The lower end 48 of the latch operating member 50 fits within this space, and a stop member 52 is secured to member 50 to control the amount of insertion of the end 48 into space 46. Member 50 is pivotally connected to the latch 25 at pivot pin 54.

Looking simultaneously at FIGS. 4 and 5, it can be seen how this slip joint between the parts of 48 and 38 as defined by the stop 52 permits self-latching of the latch 25 into the keeper 27 when the fence gate is closed.

Figure 6:
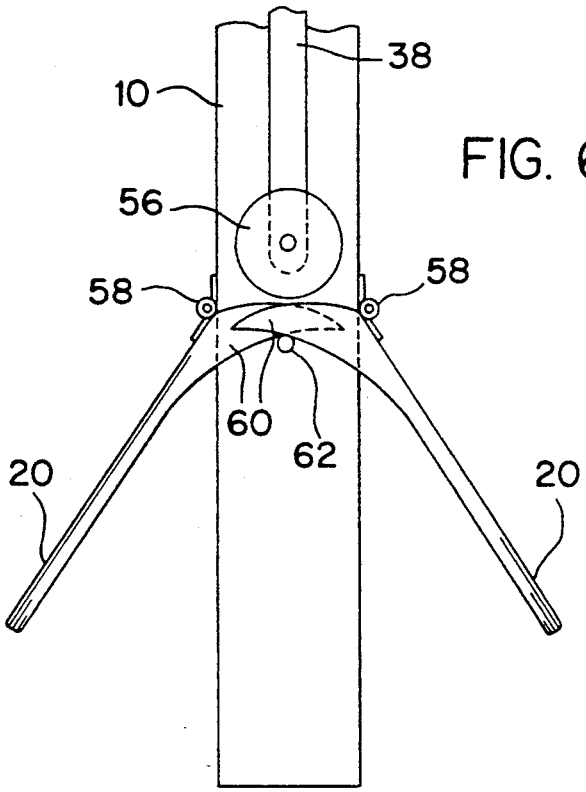
FIG. 6 is a vertical end elevational view showing dual foot pedals, according to the first embodiment of the invention.

The manner in which the foot pedals 20 operate the lower control member 38 will now be explained with reference to FIG. 6. Lower control member 38 is fitted with an anti-friction device such as a roller or the like 56. The pair of foot pedals 20 are connected to opposite sides of the housing 24 by hinges 58, or the like means. Suitable openings are provided in the sides of the housing 24 to permit entry of the operating finger portions 60 of the foot pedals 20. A stop member 62 controls the amount of rotation of the pedals 20 and thus defines the extended positions thereof shown in FIG. 6. Only ingress through the gate is deemed important. That is, it is not necessary to have the invention latch release mechanism operate to control exit from the fenced area. However, if some override were provided on the exit side, that override would invite avoidance of the safety feature of the invention on ingress. For that reason, dual pedals 20 are provided, and the invention latch must be operated in the manner set forth herein when going through the gate in either direction. However if a child-proof override or the like were added, then the invention latch could be used to control ingress to the fenced area only. Also, only one foot control is needed for a solid door as is described below.

For purposes of the present patent specification and claims, the terms "keeper" and "latch" shall have the following meanings.

The word "latch" shall mean the latch 25 of the first embodiment of FIGS. 1 through 6, as well as the latch member 68 of the second embodiment. This latch member 68 is also known as a pawl, bolt, or strike in regard to conventional and other doors. Likewise, the keeper 78, see Figure which cooperates with latch 68 in the second embodiment of the invention is also known as a strike plate and by other names.

Thus, these two terms "latch" and "keeper" are used in these ways to broaden the claims, for convenience, and to better describe all embodiments of the invention. These terms shall be understood to include all such members and equivalents thereof which may be found in other areas of application in which the invention could be used.

Figure 7:
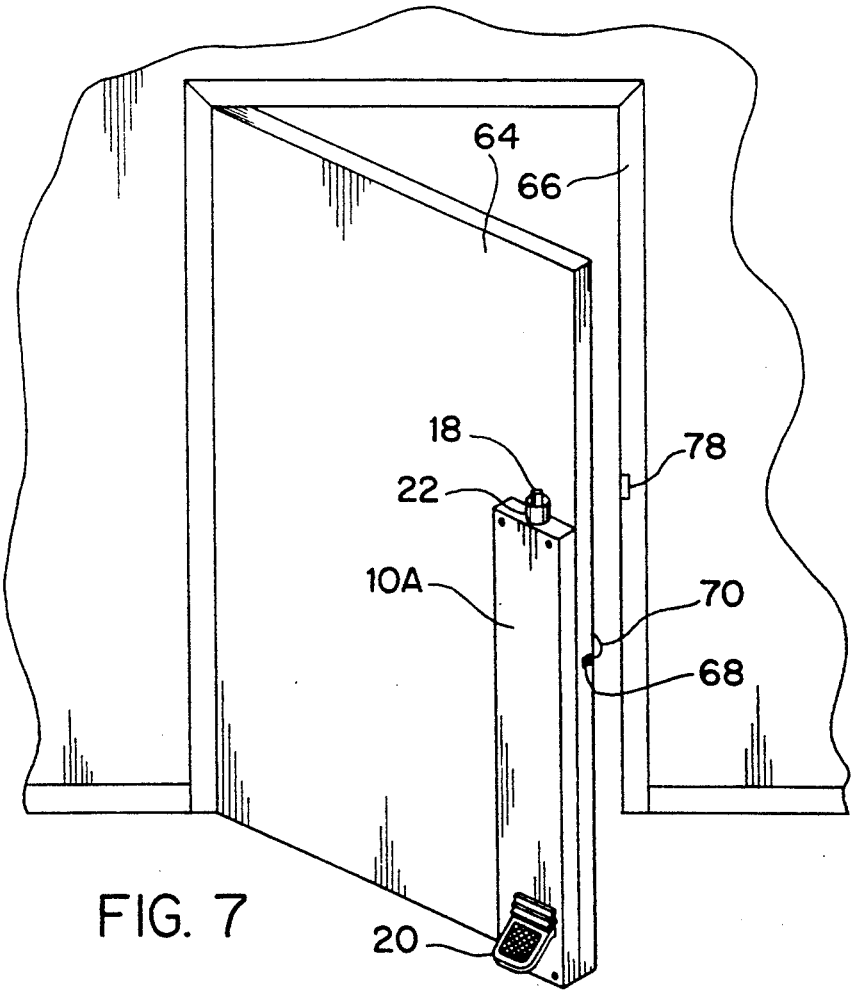
FIG. 7 is a view similar to FIG. 1 showing a second embodiment of the invention latch release mechanism applied to a door.
Figure 8:
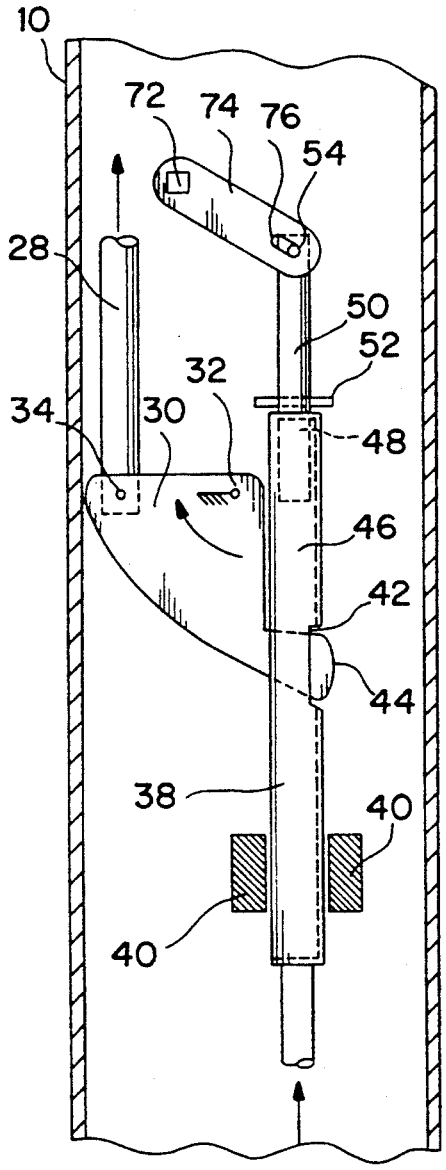
FIG. 8 is a view similar to FIG. 4 showing the second embodiment of the invention of FIG. 7.
Figure 9:
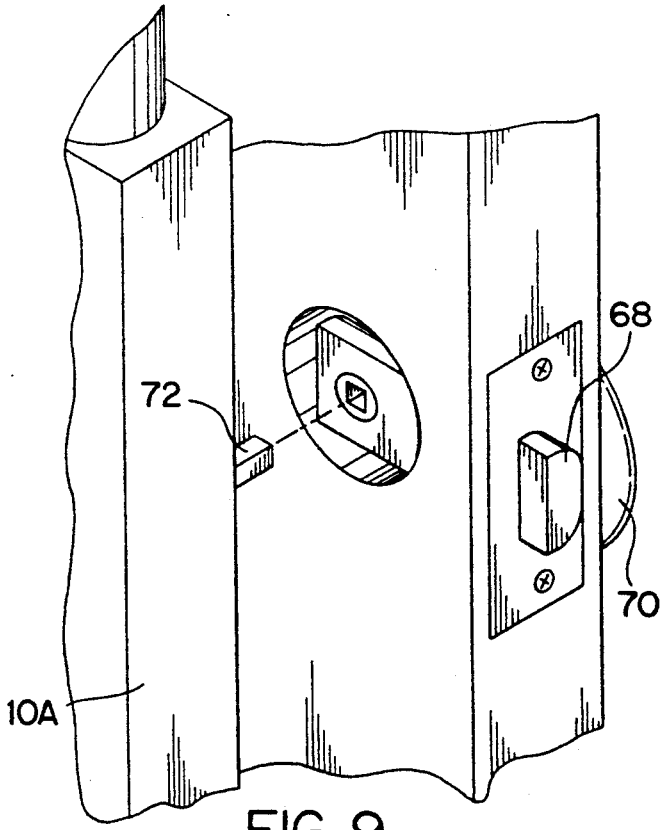
FIG. 9 is an enlarged and partially exploded perspective view of the FIG. 7 embodiment of the invention.

Referring now to FIGS. 7, 8 and 9, a second embodiment of the invention is shown as applied to a conventional door 64 which fits within a conventional door frame 66. Door 64 controls access to a room defined by solid walls. As described above, the invention is designed primarily to prevent ingress. Thus, the invention latch release mechanism 10A is on the outside of the door, and the space controlled by the door (inside the plane of the paper), is the space prohibited to small children which is controlled by the invention.

In FIGS. 7, 8 and 9, all parts the same as those described above in regard to the first embodiment are indicated by the same reference numeral.

On the other side of the door, that is controlling the egress from the prohibited space, a conventional door knob 70 is provided. This knob will operate the invention latch in a manner described below.

Referring now to FIG. 8, and comparing it to FIG. 4, it can be seen that the modifications of the second embodiment basically comprise a crank member 74, having a square operating rod 72 affixed to one end thereof, and formed with a slot 76 at the opposite end thereof. The pivot pin 54 of the first embodiment fits slidingly and cooperatively within the slot 76 in crank 74. Operating member 72, as shown in FIG. 9, fits within a cooperating opening in the shank of latch 68, and turning thereof will release the latch 68 from the cooperating keeper 78 in the door frame 66.

Since only ingress and not egress is to be controlled, only one foot pedal 20 is required in this second embodiment.

OPERATION

Referring first to FIG. 4, the manner of operation of the invention will now be explained. In order to use the invention in a normal manner, the user grasps the knob 18, thus pulling up on the upper control lever 28. This causes the lock 30 to pivot about its pivot 32 and removes finger 44 from the opening 42. That disengagement enables the foot pedals 20, just the one of the second embodiment or either one of them in the first embodiment, to be depressed which, in turn raises lower control member 38, which raises the latch 25 out of the keeper 27 permitting the gate to open.

The operation of the second embodiment of FIGS. 7, 8 and 9 should be clear from the above. Turning of operating rod 72 moves the latch 68 horizontally which horizontal motion engages and disengages it respectively with respect to the cooperating keeper or strike plate 78 in the door frame in the usual manner. Self-latching, as in the first embodiment, is also provided; the slip joint and the slot 76 permit this self-latching in the second embodiment of the invention.

In all cases, the two operations must be performed in the order stated to open the latch; i.e., first sequentially and then simultaneously. That is, the user must first lift and hold the knob 18 up thus removing lock 30 from its engagement with lower control member 38 and only then will the foot pedal(s) 20 be enabled to operate the lower control member. Operation of a foot pedal 20 first is not possible without raising upper control rod 28. Likewise, raising control rod 28 and then dropping it will not permit operation of the latch 25 or 68.

While the invention has been described in detail above, it is to be understood that this detailed description is by way of example only, and the protection granted is to be limited only within the spirit of the invention and the scope of the following claims.

What is claimed is:

1. A method of providing a latch release mechanism which is resistant to operation by a preschool child, comprising the steps of providing a latch, providing a cooperating latch keeper, providing upper and lower control members, mounting said upper and lower control members on said mechanism separated by a predetermined distance, selecting said predetermined distance such that it is greater than the distance which can be effectively spanned by a preschool child, providing means in said mechanism to require operation of said upper and lower control members in a predetermined sequence and then simultaneously in order to disengage said latch from said latch keeper, and the step of removably interlocking said upper and lower control members to prevent disengagement of said latch out of said latch keeper, said predetermined sequence requiring lifting and holding of said upper control member out of its interlocked relationship with said lower control member, connecting said lower control member to said latch, and then raising said lower control member to move said latch out of latching relationship with said keeper while said upper control member is held in its lifted position.

2. The method of claim 1, and selecting said predetermined distance to be at least 48 inches.

3. The method of claim 1, providing a knob member on said upper control member, snugly fitting said knob member within a cooperating cup member, selecting the relative dimensions of said cup member and of said knob member such that a part of the height of said knob member extends out of said cup member in the closed position of said mechanism and a part of the height of said knob member remains inside said cup member in the raised position of said knob with respect to said cup member, and providing a smooth outer surface on said knob member.

4. The method of claim 1, mounting said mechanism on a fence gate, mounting said keeper on a fence which includes said fence gate, and providing means to permit self-latching of said latch into said keeper when said gate is closed with respect to said fence.

5. The method of claim 1, mounting said mechanism on a conventional door, mounting said keeper on a door frame which cooperates with said door, and providing means to permit self-latching of said latch into said keeper when said door is closed with respect to said frame.

6. The method of claim 1, and the step of providing slip joint means in said lower control member to permit self-latching of said latch into said keeper when said latch is closed with respect to said keeper.

7. A child-proof latch release mechanism comprising a latch and a cooperating latch keeper; the combination comprising upper and lower control members, said upper and lower control members being mounted on said latch release mechanism separated by a predetermined distance, said predetermined distance being selected such that it is greater than the distance which can be effectively spanned by a preschool child, said mechanism comprising means to require operation of said upper and lower control members in a predetermined sequence and then simultaneously in order to disengage said latch from said latch keeper, said last-mentioned means to require operation comprising a lock member, means to removably interlock said lock member and said upper control member, means to connect said lower control member to said latch, said predetermined sequence requiring lifting and holding of said upper control member and pivoting of said lock member out of its interlocked relationship with said lower control member, and then raising of said lower control member to move said latch out of latching relationship with said keeper while said upper control member is held in its lifted position.

8. The combination of claim 8, said upper and lower control members each comprising an operating portion, said upper control member operating portion comprising a knob member, said lower latch control member comprising at least one foot pedal, and said predetermined distance being provided between said knob member and said foot pedal.

9. The combination of claim 8, said predetermined distance being at least 48 inches.

10. The combination of claim 8, said knob being snugly fitted within a cooperating cup member.

11. The combination of claim 10, the relative dimensions of said cup and of said knob being such that a part of the height of said knob extends out of said cup in the closed position of said mechanism and a part of the height of said knob remains inside said cup in the raised position of said knob with respect to said cup, and said knob being formed with a smooth outer surface.

12. The combination of claim 7, and said mechanism comprising means to permit self-latching of said latch into said keeper.

13. The combination of claim 12, means to connect one of said upper and lower control means to said latch, and said connect means comprising slip joint means to permit said self-latching.

14. The combination of claim 7, said lower control member including slip joint means therein to permit self-latching of said latch into said keeper.

15. The combination of claim 7, and means substantially entirely covering said latch in such a way as to prevent direct manual operation of said latch.

16. The combination of claim 7, wherein said latch release mechanism is used in conjunction with a gate for a fence, and wherein said latch is mounted on said gate and said keeper is mounted on said fence for cooperation with said latch.

17. The combination of claim 7, wherein said latch release mechanism is used in conjunction with a door mounted in a door frame, and wherein said latch is mounted on said door and said keeper is mounted in said door frame for cooperation with said latch.

* * * * *